US009316012B2

(12) United States Patent
Perry et al.

(10) Patent No.: US 9,316,012 B2
(45) Date of Patent: Apr. 19, 2016

(54) SYSTEMS AND METHODS FOR RETROFITTING A BUILDING FOR INCREASED EARTHQUAKE RESISTANCE

(71) Applicants: W. Charles Perry, San Mateo, CA (US); Parviz B. Zavareh, Sunnyvale, CA (US)

(72) Inventors: W. Charles Perry, San Mateo, CA (US); Parviz B. Zavareh, Sunnyvale, CA (US)

( * ) Notice: Subject to any disclaimer, the term of this patent is extended or adjusted under 35 U.S.C. 154(b) by 34 days.

(21) Appl. No.: 13/871,805

(22) Filed: Apr. 26, 2013

(65) Prior Publication Data

US 2015/0204098 A1 Jul. 23, 2015

(51) Int. Cl.
*E04H 9/02* (2006.01)

(52) U.S. Cl.
CPC ..... *E04H 9/027* (2013.01); *E04H 9/021* (2013.01); *E04H 9/024* (2013.01); *E04H 9/028* (2013.01)

(58) Field of Classification Search
CPC ..... E04H 9/027; E04H 9/021; E04H 9/024; E04H 9/028
USPC ..... 52/167.3, 167.4
See application file for complete search history.

(56) References Cited

U.S. PATENT DOCUMENTS

| | | | | | |
|---|---|---|---|---|---|
| 4,910,929 | A * | 3/1990 | Scholl | 52/167.3 |
| 4,922,667 | A * | 5/1990 | Kobori et al. | 52/167.2 |
| 4,947,599 | A * | 8/1990 | Sadahiro | 52/223.12 |
| 5,375,382 | A * | 12/1994 | Weidlinger | 52/167.3 |
| 6,247,275 | B1 * | 6/2001 | Taylor | 52/167.3 |
| 6,516,583 | B1 * | 2/2003 | Houghton | 52/655.1 |
| 6,681,538 | B1 * | 1/2004 | Sarkisian | 52/289 |
| 6,920,724 | B1 * | 7/2005 | Hundley | 52/167.3 |
| 7,076,926 | B2 * | 7/2006 | Kasai et al. | 52/167.8 |
| 2007/0292204 | A1 * | 12/2007 | Hackney | 403/93 |
| 2008/0022610 | A1 * | 1/2008 | Gjelsvik et al. | 52/167.3 |
| 2008/0289267 | A1 * | 11/2008 | Sarkisian | 52/167.3 |
| 2009/0025309 | A1 * | 1/2009 | Deans et al. | 52/92.2 |
| 2011/0131896 | A1 * | 6/2011 | Hansen | 52/167.3 |
| 2011/0239551 | A1 * | 10/2011 | Goto et al. | 52/167.3 |

FOREIGN PATENT DOCUMENTS

| | | | | |
|---|---|---|---|---|
| JP | 02020767 | A * | 1/1990 | E04G 23/02 |

* cited by examiner

*Primary Examiner* — Adriana Figueroa

(74) *Attorney, Agent, or Firm* — Derek R. Van Gilder

(57) ABSTRACT

A system for retrofitting a building to make the building more earthquake resistant. The system includes a seismically-tuned (S-T) frame. The S-T frame is configured to absorb a first portion of the forces imparted by an earthquake and transfer a second portion of the forces in a distributed manner to areas of a building such that they can be better withstood. The system also includes a rigid truss diaphragm. The rigid truss diaphragm is connected to the S-T frame and configured to transfer the second portion of the forces imparted by an earthquake to an overlying structure.

6 Claims, 11 Drawing Sheets

SYSTEMS AND METHODS FOR RETROFITTING A BUILDING FOR INCREASED EARTHQUAKE RESISTANCE

CROSS-REFERENCE TO RELATED APPLICATIONS

Not applicable.

BACKGROUND OF THE INVENTION

Over the preceding 60 years, numerous large earthquakes have caused collapses and loss of life in structures that were designed and built in accordance with the custom and practice of the industry at the time of their construction. Investigation and analysis of these failures identified several critical deficiencies in these customs and practices:

1. Multi-story buildings with weak, open, or soft stories.
2. Buildings with irregular shapes, distribution of mass, location of lateral load resisting systems, et cetera.
3. Inadequate resistance to lateral loads
4. Inadequate connections between structural members and lateral load resisting systems.

The cost of the damage and loss of life in these buildings caused by a basic service earthquake (BSE) far exceeds the ability of individuals, building owners, and insurance companies to compensate. Consequently, the cost of such compensation has been borne by local, state, and federal governments.

In response to these developments, local and state governments have passed laws that require or recommend the retrofit of such buildings to prevent collapse in a BSE-2 (2% probability of exceedance in 50 years) and loss of life in BSE-1 (10% probability of exceedance in 50 years). Insurance companies will not insure such buildings until they are retrofitted. And banks might not accept such buildings as collateral for loans until they are retrofitted.

The conventional methods for seismically retrofitting such buildings include the following methods:

1. Fully rebuilding the existing structure to meet current requirements.
2. Partially rebuilding the existing structure to prevent collapse yet allow such damage as to render the building valueless.
3. Installing special moment resisting frames & foundations in parallel with the existing structure to resist the seismic loads.
4. Installing conventional concentrically braced frames & foundations in parallel with the existing structure to resist the seismic loads.
5. Installing tuned masses and/or dampers to reduce the effect of seismic loads.
6. Installing base isolators to separate the building from the seismic loads.
7. Installing eccentrically braced frames & foundations in parallel with the existing structure to resist the seismic loads.

The inherent problem with such design and retrofit approaches is the lack of force distribution control that is needed in buildings with soft, weak, open, or irregular stories to adequately tune the stiffness of the superstructure with added lateral resisting elements such as those listed above. In other words, there are no controlled interactions between the two systems (existing and newly added) to avoid local failures and/or fine tune the required harmonic and tolerated displacements of the entire building as a single system. In theory, if one could retrofit the soft, weak, open, or irregular story of the superstructure proportionally along the height of the building, the damage and loss of life in these buildings caused by a BSE due to premature collapse of the soft, weak, open, or irregular story could be avoided.

Additionally, the total cost of the aforementioned conventional retrofits typically outweighs their short-term economic benefit or their amortized cost exceeds the available income generated by the building. The result is laws, rules, and regulations that are not properly enforced, that are delayed, or that are retracted (or not passed in the first place) in the face of opposition from building owners who claim economic hardship, inverse condemnation, or unconstitutional taking. When insurance and financing are denied, such buildings become public nuisances.

Accordingly, there is a need in the art for a low cost system that can be used to retrofit buildings and increase their earthquake resistance.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a system for retrofitting a building to make the building more earthquake resistant. The system includes a seismically-tuned (S-T) frame. The S-T frame is configured to absorb a first portion of the forces imparted by an earthquake and transfer a second portion of the forces in a distributed manner to areas of a building such that they can be better withstood. The system also includes a rigid truss diaphragm. The rigid truss diaphragm is connected to the S-T frame and configured to transfer the second portion of the forces imparted by an earthquake to an overlying structure.

Another example embodiment includes a system for retrofitting a building to make the building more earthquake resistant. The system includes a seismically-tuned (S-T) frame. The S-T frame is configured to absorb a first portion of the forces imparted by an earthquake and transfer a second portion of the forces in a distributed manner to areas of a building such that they can be better withstood. The S-T frame includes an articulated frame and a concentric brace configured to prevent deformation of the articulated frame beyond a predetermined amount. The system also includes a rigid truss diaphragm. The rigid truss diaphragm is connected to the S-T frame and configured to transfer the second portion of the forces imparted by an earthquake to an overlying structure. They system further includes a friction bolted connection configured to connect the S-T frame to the rigid truss diaphragm and act as a regular non-slip connection until loads are applied in excess of a pre-determined threshold. The system additionally includes a transition configured to connect the rigid truss diaphragm to the overlying structure.

Another example embodiment includes a method for retrofitting a building to increase earthquake resistance. The method includes securing a seismically-tuned (S-T) frame in the building. The method also includes connecting a rigid truss diaphragm to the S-T frame. The method further includes connecting the rigid truss diaphragm to an overlying structure.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
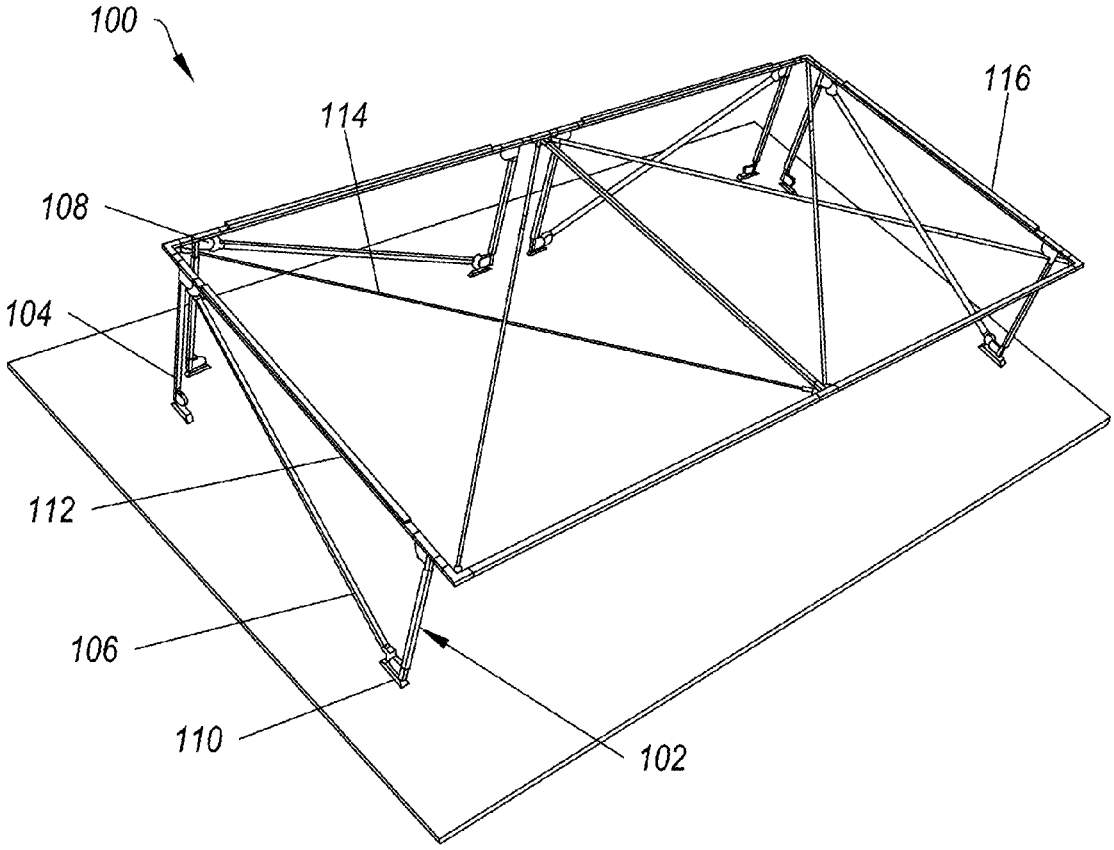
FIG. 1A illustrates a top elevation view of an example of a system for retrofitting a building to make the building more earthquake resistant.
Figure 1B:
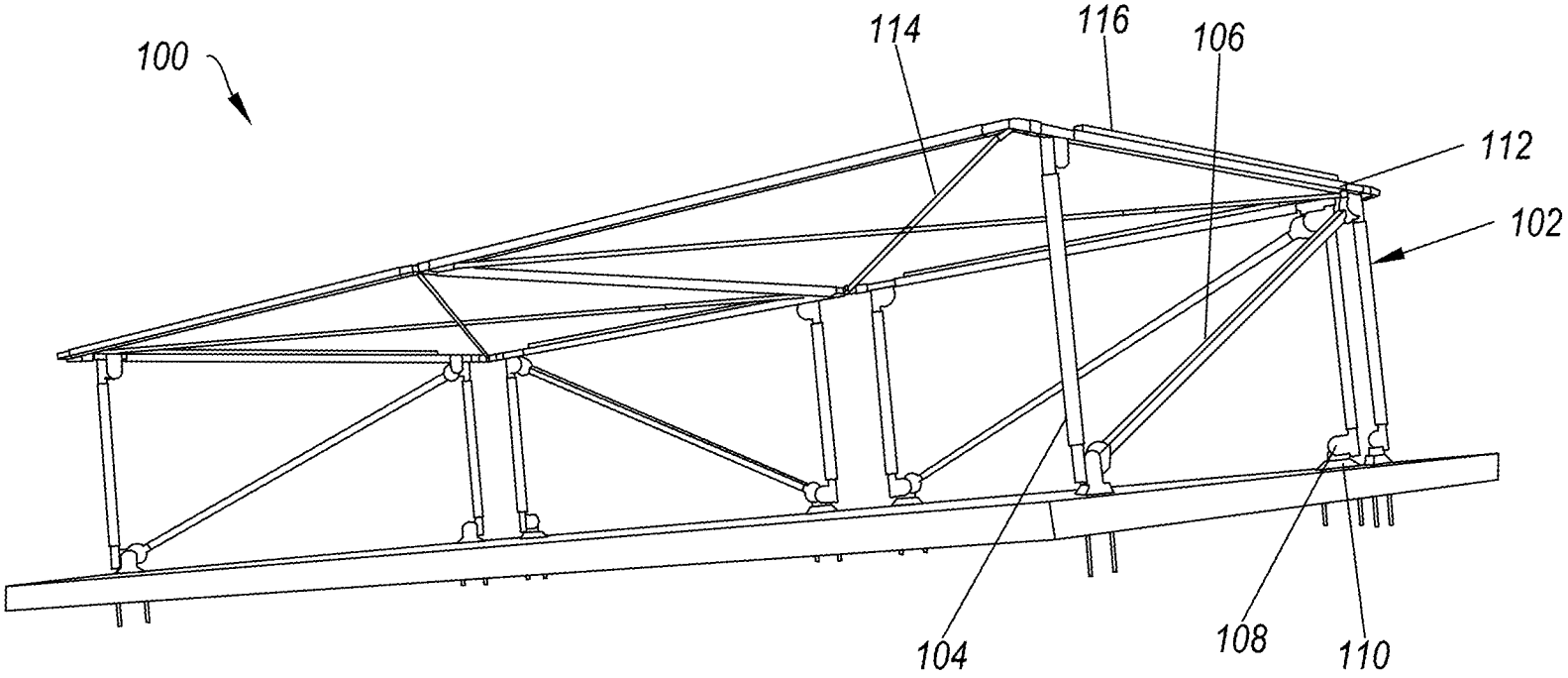
FIG. 1B illustrates a side elevation view of an example of a system for retrofitting a building to make the building more earthquake resistant.

FIGS. 1A and 1B illustrate an example of a system 100 for retrofitting a building to make the building more earthquake resistant. FIG. 1A illustrates a top elevation view of an example of a system 100 for retrofitting a building to make the building more earthquake resistant; and FIG. 1B illustrates a side elevation view of an example of a system 100 for retrofitting a building to make the building more earthquake resistant. In particular, the system 100 can be used to reduce and/or redistribute forces within a building during an earthquake. Earthquake resistant structures are intended to withstand the largest earthquake of a certain probability that is likely to occur at their location. This means the loss of life should be minimized by preventing collapse of the buildings for rare earthquakes while the loss of functionality should be limited for more frequent ones. Thus, the system 100 can reduce and/or redistribute forces within the building to increase earthquake resistance. Specifically, the system 100 can satisfy the FEMA and ASCE recommended safety criteria: "collapse prevention" in a 2% in 50 year earthquake and "life safety" in a 10% in 50 year earthquake. If the upper levels do not have design deficiencies, then the system 100 can be tuned to the enhanced safety objective of "immediate occupancy" in a 10% in 50 year earthquake. The system can be further tuned to prevent damage under smaller earthquakes and wind loads. This means that dwellings are habitable and repairable after a major earthquake. No other system offers this.

In particular, the system 100 can transfer a portion of the lateral motion from an earthquake through an existing soft, open, weak, or irregular story in a multi-story building to an overlying story. This transfer is affected without relying on the seismic strength of this existing soft, open, weak, or irregular story. Furthermore, lateral accelerations that exceed the strength of the overlying story are reduced in magnitude via non-linear friction damping to minimize damage to the overlying story (i.e., the induced energy from seismic shock force is dissipated via friction and controlled displacements). When such lateral accelerations cannot be so reduced, displacement of the overlying story is then limited to prevent collapse of the soft, open, weak, or irregular story.

FIGS. 1A and 1B show that the system 100 can include a Seismically-Tuned Articulated Braced (S-T) frame 102. The S-T frame 102 is configured to absorb some of the forces imparted by an earthquake to a building and transfer the remaining forces to areas in such a manner that they can be better withstood. By analogy, the S-T frame 102 functions as a shock absorber in a car. When a car rolls over a large hole in a road, the shock absorber reduces shock felt in the passenger compartment. If the hole is too large or the speed too great for the shock absorber to fully reduce, a bumper prevents damage to the car and allows a greater percentage of the shock into the passenger compartment.

FIGS. 1A and 1B show that the S-T frame 102 can include an articulated frame 104. The articulated frame 104 can include a rectangular or quadrilateral frame that has one or more articulated joints. I.e., the frame 104 can include flexible joints. This allows sections of the articulated frame 104 to move relative to one another. In particular, the articulated frame 104 can "skew" or lean from vertical to a non-vertical position as described below. Consequently, the articulated frame 104 acts as an inverted pendulum.

One of skill in the art will appreciate that the articulated frame 104 provides a number of benefits. For example, the articulated frame 104 can fit an existing irregular building geometry without customizing each component. I.e., the articulated frame 104 can be sized according the building geometry but other components of the system 100 can remain unchanged, allowing for easy engineering of a retrofit. Additionally or alternatively, the articulated frame 104 does not require interrupting existing building utility services (plumbing, gas, HVAC, electricity, etc). In particular, the articulated frame 104 can be attached to an existing building without requiring utility services to be shut off, even temporarily. In addition, the articulated frame 104 minimizes the footprint of the system 100, meaning that existing utility structures, such as pipes, duct work, etc. do not need to be moved to allow for installation of the articulated frame 104. This reduced footprint prevents, for example, the loss of parking space when installed in a soft, open, or weak story that provides covered parking both during and after construction.

FIGS. 1A and 1B also show that the S-T frame 102 can include a concentric brace 106. The concentric brace 106 can pass through the center of the articulated frame 104. The concentric brace 106 can be configured to restrict the motion of the articulated frame 104. I.e., the concentric brace 106 can ensure that the articulated frame 104 does not distort beyond a desired amount. The amount of distortion allowed by the concentric brace 106 can depend on the capacity of the structure to distort or sway under the force of an earthquake and the applicable building codes for earthquake resistance. That is, the amount of distortion allowed in the articulated frame 104 by the concentric brace 106 can be customized to the building which is being retrofitted.

FIGS. 1A and 1B further show that the S-T frame 102 can include friction bolted connections 108. The friction bolted connections 108 can act as regular non-slip connections until loads are applied in excess of the capacity of the supported structure. After this load, the slippage of these connections is used to damp the accelerations transmitted through them. The magnitude of this slippage is limited to prevent collapse of the frame.

FIGS. 1A and 1B additionally show that the S-T frame 102 can include one or more anchors 110. The anchors 110 can allow the articulated frame 104 to be attached to a wall, floor, foundation, footing or other attachment point in the area. For example, the anchors 110 can be attached to the articulated frame 104 using a friction bolted connection 108 to a foundation or retaining wall such that lateral ground motion along the foundation or wall is transferred to the articulated frame 104. This motion is converted into a reduced damped force in the articulated frame 104. This damped force is transferred to the RTD 112. The RTD 112 transfers the reduced damped forced in a distributed manner to the supported structure while preventing lateral motion beyond desired levels.

FIGS. 1A and 1B also show that the system 100 can include a rigid truss diaphragm (RTD) 112. The RTD 112 can include a truss structure that acts to transfer force to the upper structure. A truss is a structure comprising one or more triangular units constructed with straight members whose ends are connected at joints referred to as nodes. External forces and reactions to those forces are considered to act only at the nodes and result in forces in the members which are either tensile or compressive forces. A truss is said to be rigid when there is effectively no relative motion of any point on any member of the truss with respect to any other point on any other member of the truss. This rigidity is relative to the structure to which the RTD 112 connects. In most circumstances, horizontal diaphragms in buildings resist in-plane deformation via shear resistance; consequently, they are more flexible than a truss. Thus, the RTD 112 provides a stable horizontal plane which is connected to the upper structure, transferring force to the upper structure in a distributed manner via a series of individual connection points along the chords of the RTD 112.

The RTD 112 solves the "flexible diaphragm" problem. Floor and ceiling diaphragms in buildings with soft, open, or weak stories are typically flexible and weak. Individual frames concentrate forces where these frames join a flexible diaphragm. This concentrated force causes the diaphragm to fail. Additionally, the diaphragm might be restrained from moving laterally where it connects to a frame, but the portion of the diaphragm away from this frame flexes outwards due to its flexibility. The RTD eliminates these problems by distributing the force from the frames throughout its entire length and by stiffening the diaphragm to which it is attached.

FIGS. 1A and 1B show that the RTD 112 can be connected to the articulated frame 104 using a friction bolted connection 108. Thus, the articulated frame 104 and adjoining RTD 112 can change shape under force from a rectangle to a parallelogram. A parallelogram is a simple (non self-intersecting) quadrilateral with two pairs of parallel sides. I.e., the length of the sides of the articulated frame 104 and the RTD 112 remain constant and the RTD 112 remains horizontal but the angle between intersecting sides may change under force. This change of angle allows the articulated frame 104 to absorb and dampen the force of the earthquake without bending or failing.

FIGS. 1A and 1B also show that the RTD 112 can include a tie rod 114. A tie rod is a slender structural unit used as a tie capable of carrying tensile loads. The tie rod 114 can horizontally connect corners of an articulated frame 104 or proximate articulated frames 104. I.e., the tie rod 114 can be located in a horizontal (or nearly horizontal plane) and secure nearby articulated frames 104 to one another. That is, the tie rod 114 can help the RTD 112 to remain rigid, even under stress.

FIGS. 1A and 1B further show that the system 100 can include a transition 116. The transition 116 can allow the S-T frame 102 and RTD 112 to be connected to the underside of the overlying story to which the forces will be transferred. For example, the transition 116 can be connected to the ceiling (i.e., floor of the upper story) within a building and the RTD 112.

In operation, when an earthquake accelerates the ground beneath the building, the system 100 initially transfers the acceleration through the S-T frame 102 and the RTD 112 because the friction bolted connections 108 initially prevent deformation. I.e., the S-T frame 102 and the RTD 112 remain "elastic" when the force is below the threshold. When the acceleration exceeds the threshold force, the friction bolted connections 108 of the S-T frame 102 and RTD 112 begin to slip. This slippage allows the joints of the S-T frame 102 and RTD 112 to rotate and the S-T frame 102 and RTD 112 to take the form of a swaying rhombus. As the S-T frame 102 and RTD 112 sway, the concentric brace 106 prevents it from collapsing, as described below. Additionally, the slippage of the friction bolted connections 108 dampen the ground accelerations through energy dissipation and prevent excess transmission of the forces into the overlying story. This same process applies to wind loads.

Figure 2:
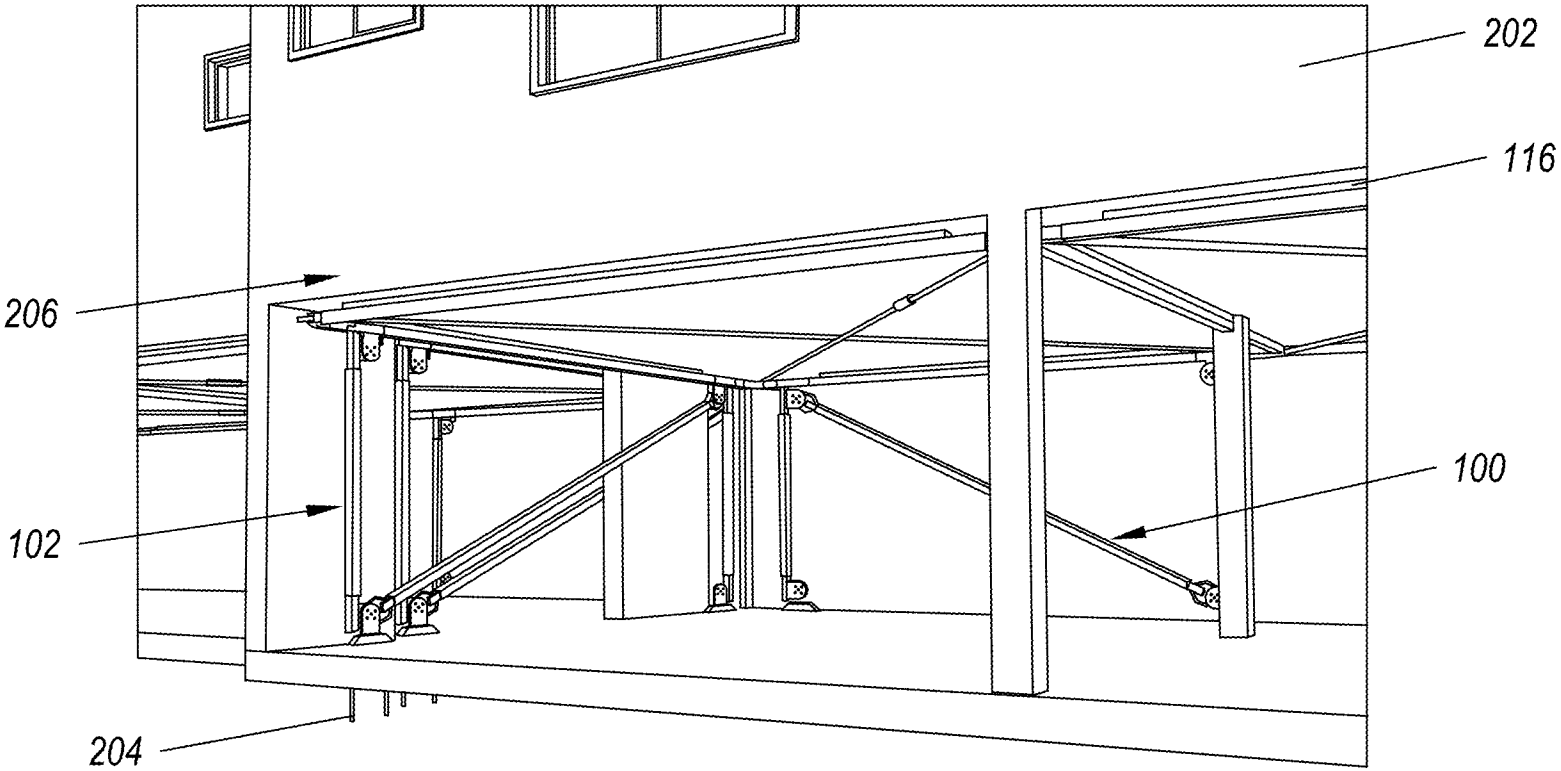
FIG. 2 illustrates an example of the system installed in a building.

FIG. 2 illustrates an example of the system 100 installed in a building 202. The system 100 can be installed within a soft, open, weak, or irregular story of the building 202. For example, the soft, open, weak, or irregular story can include a garage, parking structure or other large open spaces. Additionally or alternatively, the system 100 can be installed in multiple stories within the building 202. E.g., if the building 202 included a large open room above the parking structure, neither the parking structure nor the large open room would be sufficiently resistant to lateral forces. Therefore, a first system 100 can be installed within the parking structure and a second system 100 can be installed within the large open room effectively transferring the forces to the third story, where it can be resisted within the structure of the building 202.

FIG. 2 shows that the anchors 110 can include one or more bolts 204. The one or more bolts 204 can be installed into the footing, foundation, retaining wall, floor or underlying structure of the soft, open, weak, or irregular story. For example, the bolts 204 can be secured directly into the footing, foundation, retaining wall, floor or underlying structure. Additionally or alternatively an anchor or other mechanism can be sunk into the footing, foundation, wall, floor or underlying structure and the bolts 204 can be threaded into the anchor or other mechanism.

FIG. 2 also shows that the transition 116, and indirectly the S-T frame 102, is connected to the overlying story 206. For example, the transition 116 can be attached to the flexible ceiling diaphragm of the open, weak, or irregular story. The overlying story 206 can thus be left largely untouched during installation, allowing for the portion of the building 202 to which modifications must be made reduced to a minimum. This allows the building 202 to remain in use (e.g., the parking structure can still be used for parking and the living spaces inhabited) even during installation. In addition, any openings to the building 202 can remain unmodified. Thus, the opening to the parking structure, for example, does not need to be narrowed beyond the width required for continued parking for proper support.

Figure 3:
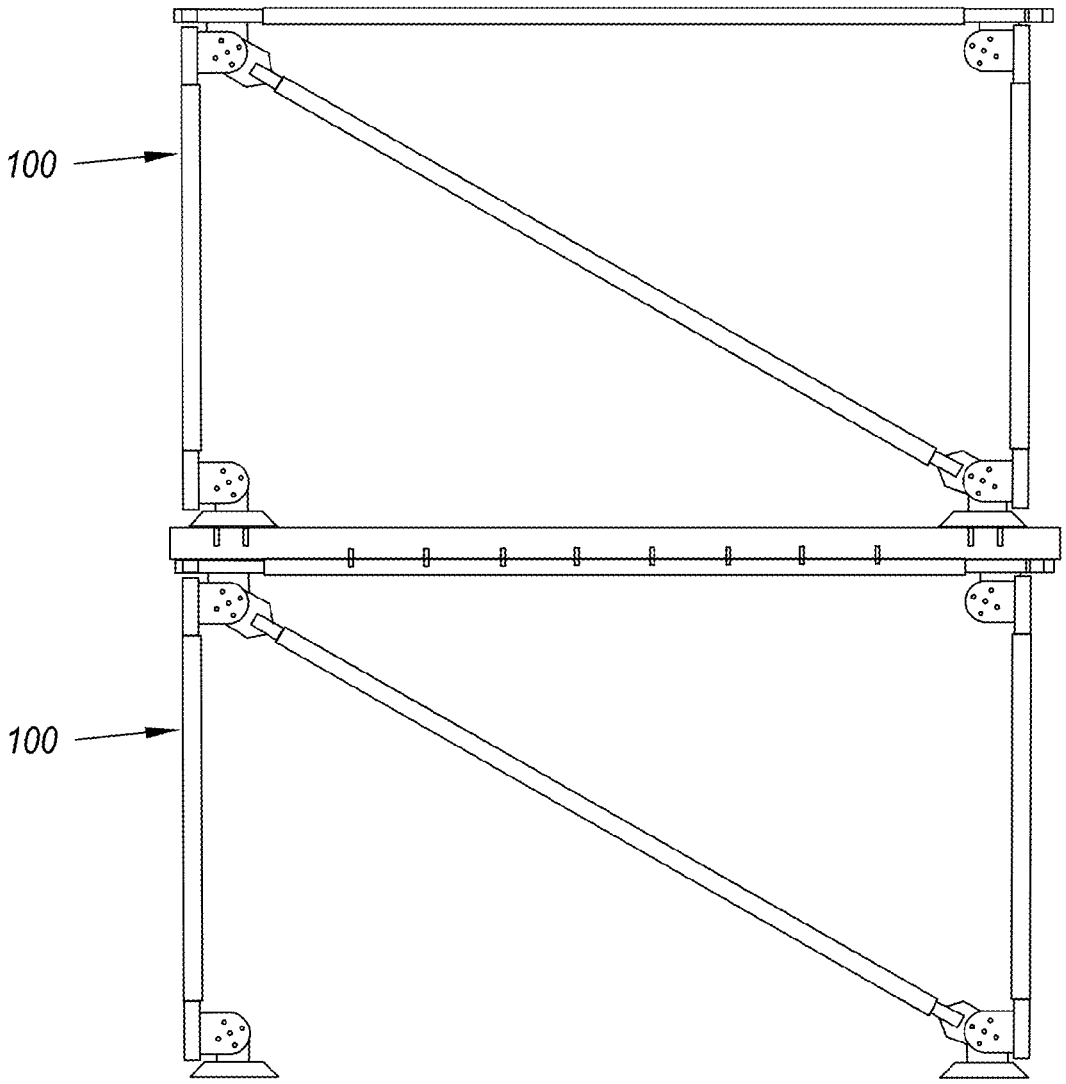
FIG. 3 illustrates an example of the system installed in overlying stories.

FIG. 3 illustrates an example of the system 100 installed in overlying stories. Prior art systems are not suitable for installation in multiple stories. In particular, existing systems fail because they only transfer the force or resist the force. In contrast, the system 100 dampens the force via the friction bolted connections 108 until it passes a threshold level at which point the force is transferred to the overlying story (such as overlying story 206 of FIG. 2). For example, if the system 100 dampens 100% of the force then the remaining 20% is transferred to the overlying story. The system 100 in the overlying story 302 then dampens the forces in that story until it passes a second threshold level at which point the force above the threshold level is transferred to a second overlying story 302. One of skill in the art will appreciate that the first threshold level and the second threshold level need not be the same. In particular, each story can be given a threshold level configured for that story and/or space.

Figure 4:
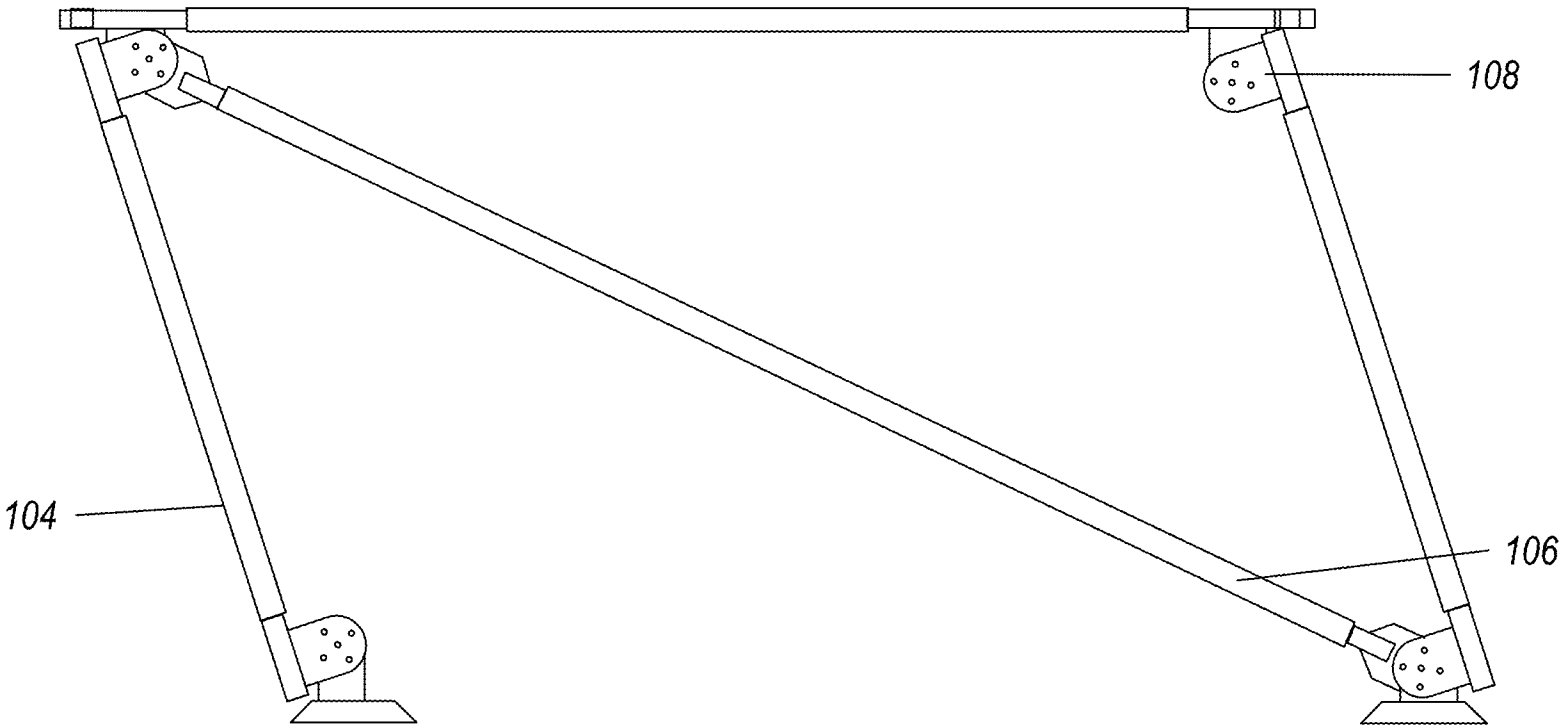
FIG. 4 illustrates an example of an articulated frame deformed under lateral forces.

FIG. 4 illustrates an example of an articulated frame 104 deformed under lateral forces. The articulated frame 104 resists deformation, because of friction bolted connections 108 as discussed below, until a certain force is applied. The articulated frame 104 then deforms in conjunction with the attached structure. I.e., the structure and the articulated frame 104 both deform, transferring force to an overlying structure.

FIG. 4 shows that the rectangular shape of the articulated frame 104 has deformed into a parallelogram with non-vertical sides. I.e., the top and bottom remain horizontal but the sides have become non-vertical. As the articulated frame 104 deforms, the concentric brace 106 resists further deformation. Thus, the threshold for further deformation decreases with deformation. This decreasing threshold prevents deformation beyond the ability of the building and the articulated frame 104 to withstand.

Figure 5:
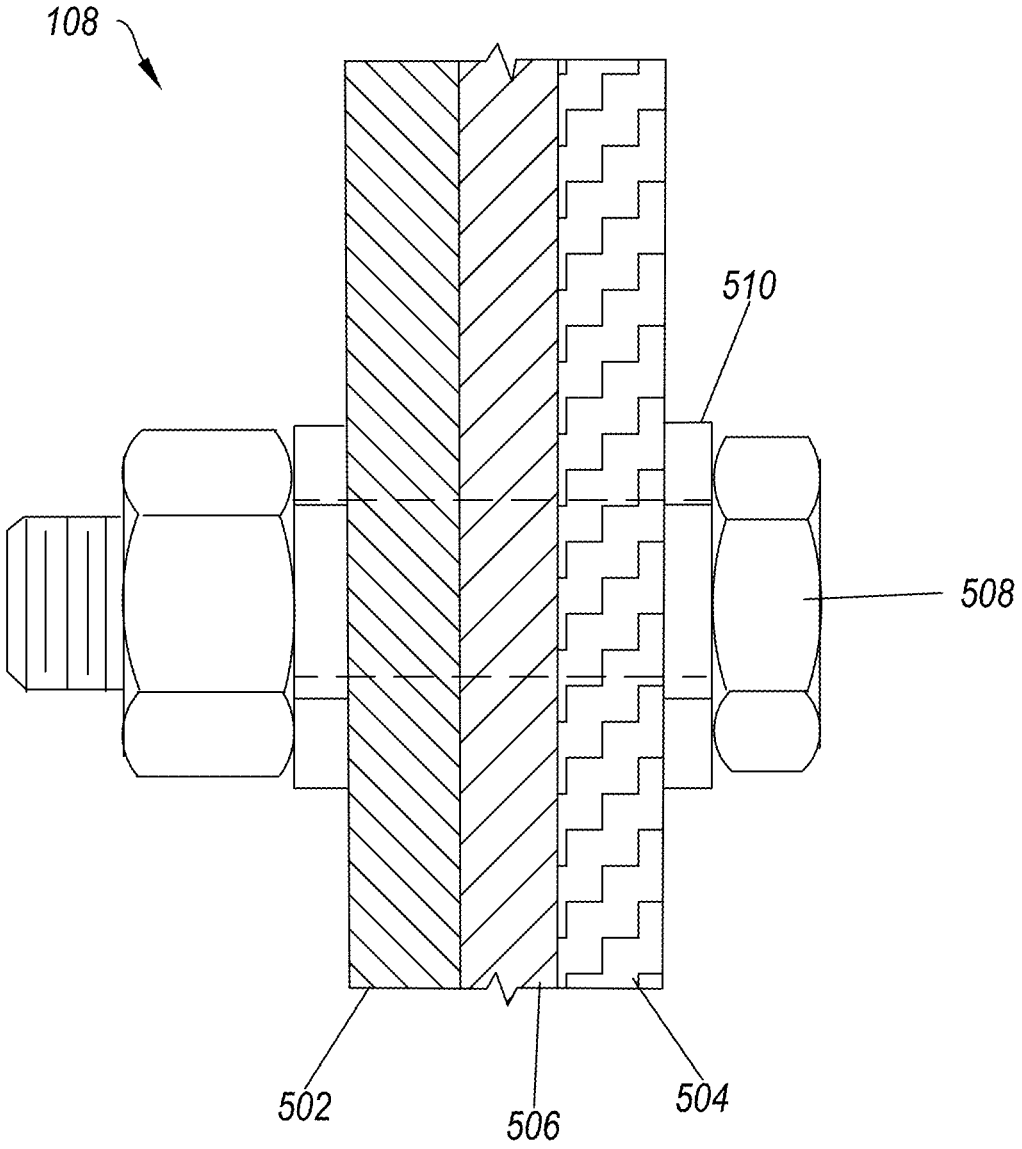
FIG. 5 illustrates an example of a friction bolted connection.

FIG. 5 illustrates an example of a friction bolted connection 108. The friction bolted connection 108 can be a connection that allows movement of the constituent parts only beyond a specific threshold of applied force. I.e. the fiction bolted connection 108 can be adjusted to set the threshold at a desired level. Consequently, the friction bolted connection 108 is tunable to any desired threshold.

FIG. 5 shows that the friction bolted connection 108 can include a first attachment 502. The first attachment 502 can include a circular plate that is configured to attach to the other connection parts. I.e., the first attachment 502 can be connected to the other parts of the friction bolted connection 108, as described below. For example, the first attachment 502 can be permanently attached to a portion of the articulated frame 104 of FIGS. 1A and 1B, allowing it to be connected to other portions of the S-T frame.

FIG. 5 also shows that the friction bolted connection 108 can include a second attachment 504. The second attachment 504 can be secured to an external device configured to connect to the first attachment 502. For example, the second attachment 504 can include the RTD 112 or anchor 110 of FIGS. 1A and 1B allowing the RTD 112 or anchor 110 to be attached to the articulated frame 104.

FIG. 5 further shows that the friction bolted connection 108 can include a third attachment 506. The third attachment 506 can be secured to a second external device configured to connect to the first attachment 502 and the second attachment 504. For example, the third attachment 506 can include the concentric brace 106 of FIGS. 1A and 1B. Additionally or alternatively, the third attachment can include a spacer plate or other device configured to properly space the friction bolted connection 108.

FIG. 5 additionally shows that the friction bolted connection 108 can include a bolt 508. The bolt 508 can include a threaded shaft and a nut to hold the shaft in the desired position. The tighter the nut is secured on the bolt 508 (i.e., the more the nut is threaded onto the shaft) the higher the compression on the first attachment 502, the second attachment 504 and the third attachment 506. Because the amount of friction is proportional to the normal force (in this case, the compression force applied by the bolt 508) the tighter the bolt 508, the more friction applied to the first attachment 502, the second attachment 504 and the third attachment 506. I.e., the bolt 508 can be tightened or loosened to change the threshold of deformation, described above. One of skill in the art will appreciate that multiple bolts 508 can be used to allow the friction bolted connection 108 to be adjustable, both in angle of connection and strength of compression.

FIG. 5 moreover shows that the friction bolted connection 108 can include a washer 510. The washer 510 is a thin plate (typically disk-shaped) with a hole (typically in the middle) that is normally used to distribute the load of the bolt 508. The washer 510 prevents the loss of pre-load due to Brinelling, localized yielding, and high stress after torque is applied to the bolt 508.

Figure 6:
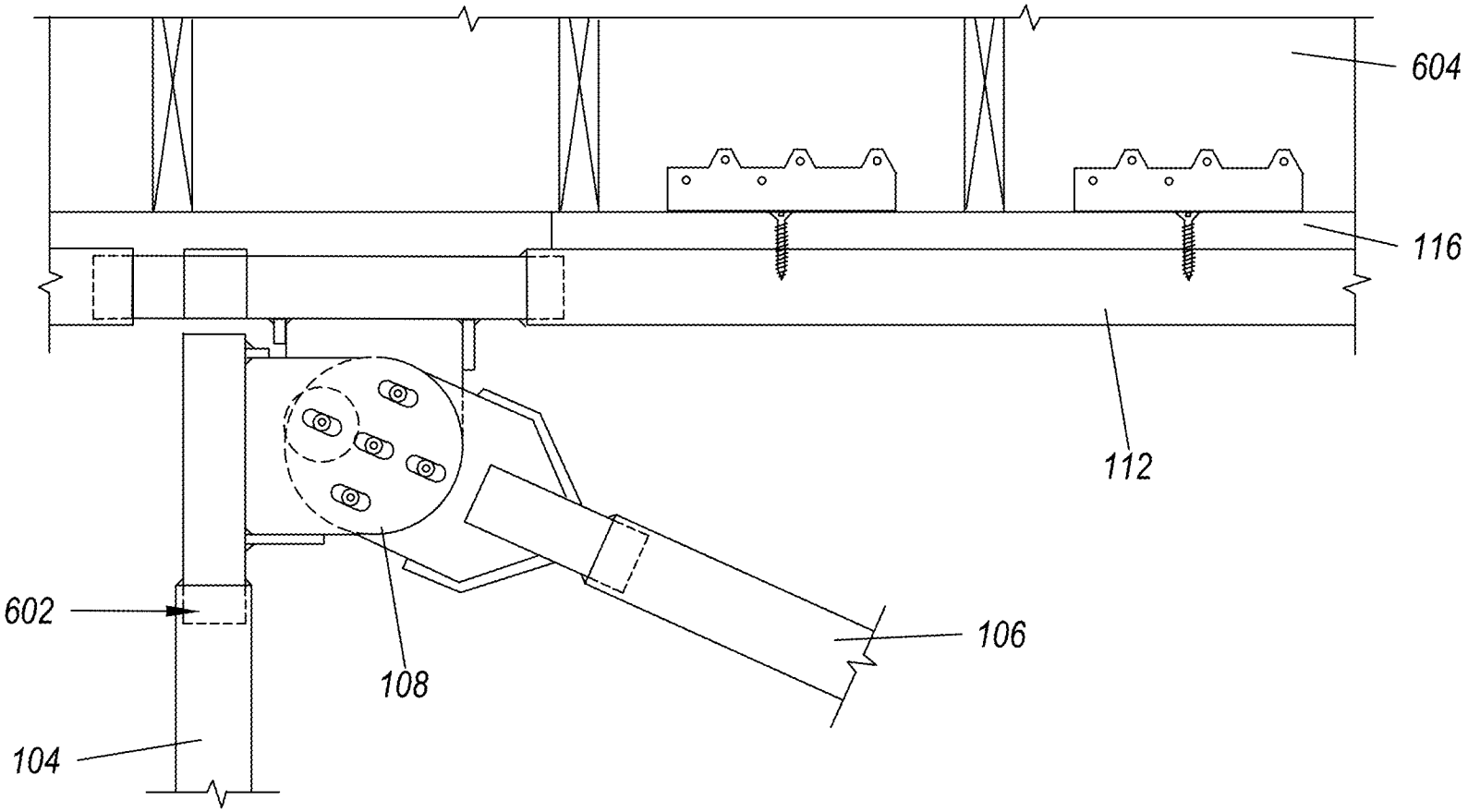
FIG. 6 illustrates an example of the system connected to an overlying structure.

FIG. 6 illustrates an example of the system 100 connected to an overlying structure. The system 100 can include a rigid connection to the overlying structure. I.e., the connection can effectively transfer forces that cannot be dampened by the system 100 to the overlying structure.

FIG. 6 shows that the articulated frame 104, the concentric brace 106 and the RTD 112 have slip connections 602 that are welded in the field after assembly. This allows the articulated frame 104, the concentric brace 106 and the RTD 112 to be sized according to the desired installation space. I.e., the articulated frame 104, the concentric brace 106 and the RTD 112 can be designed for the installation space and the slip connections 602 can be adjusted, on site, to conform exactly to the installation space.

FIG. 6 also shows that the transition 116 can connect the RTD 112 to the overlying story 604. In particular, the RTD 112, the transition 116 and the overlying story 604 can be bolted to one another, forming a rigid connection. This rigid connection can effectively transfer forces from the underlying story to the overlying story 604. I.e., the lateral forces "bypass" the open, weak, or irregular story.

Figure 7:
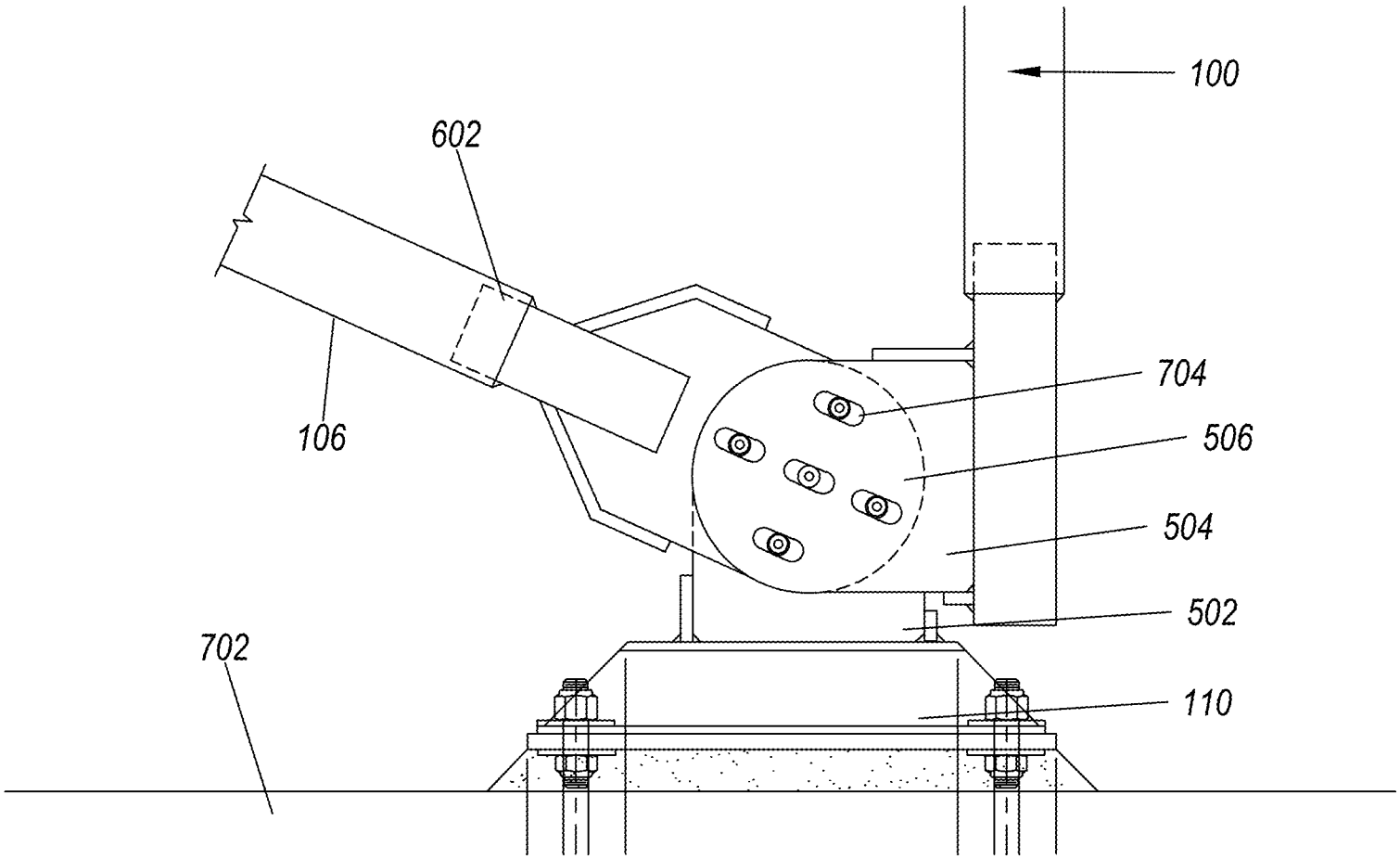
FIG. 7 illustrates an example of the system connected to an underlying structure.

FIG. 7 illustrates an example of the system 100 connected to an underlying structure 702. For example, the system 100 can be attached to a floor, foundation, footing or other structure under the soft, open, weak, or irregular story. In particular, the anchor 110 can be used to provide a rigid connection to the underlying structure 702. I.e., the connection can effectively transfer forces from the underlying structure to the system 100.

FIG. 7 shows that the third attachment 506 can include one or more slots 704. The one or more slots 704 can allow the connection point of the third attachment 506 relative to the first attachment 502 and the second attachment 504 to be adjusted. I.e., the one or more slots 704 can allow the bolts 508, the first attachment 502 and the second attachment 504 all to move relative to the third attachment 506. This relative adjustment can allow for changes during installation. Additionally or alternatively, the relative adjustment can slip during seismic events to prevent excessive loads from being transmitted from the supporting structure to system elements.

Figure 8:
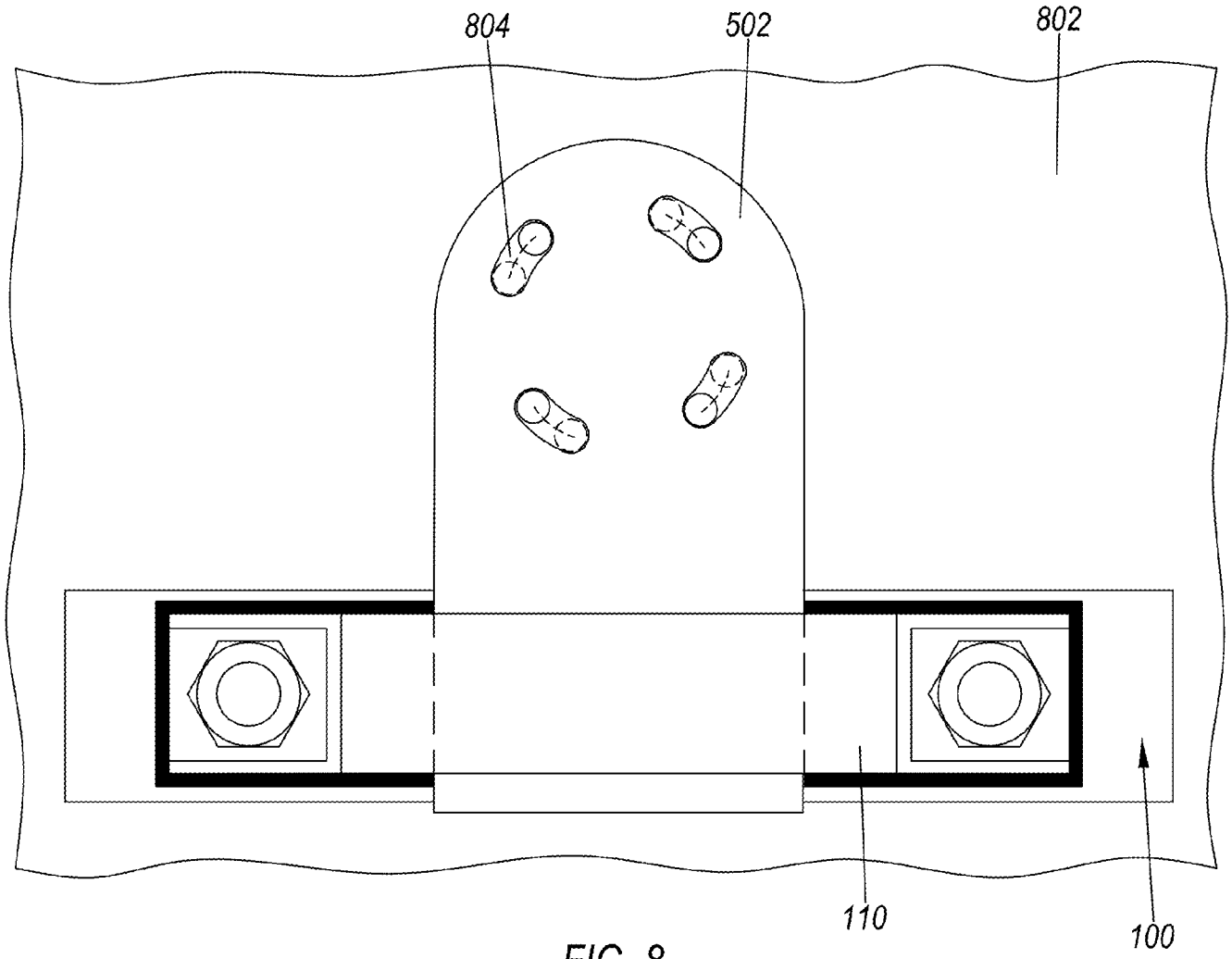
FIG. 8 illustrates an example of the system connected to a side structure.

FIG. 8 illustrates an example of the system 100 connected to a side structure 802, such as a retaining wall. For example, the system 100 can be attached to a retaining wall of the soft, open, weak, or irregular story. In particular, the anchor 110 can be used to provide a rigid connection to the retaining wall. I.e., the connection can effectively transfer forces from the retaining wall to the system 100.

FIG. 8 shows that the first attachment 502 can include one or more curved slots 804. These same curved slots 804 can be included in the second attachment 504. The one or more curved slots 804 can allow the connection point of the first attachment 502 to rotate relative to the second attachment 504 and the third attachment 506 of FIG. 5. I.e., the one or more curved slots 804 can allow the bolts 508, the second attachment 504 and the third attachment 506 of FIG. 5 all to be rotated relative to the first attachment 502. This relative adjustment can allow for changes in the angle of the first attachment 502, the second attachment and the third attachment relative to one another during installation. For example, the curved slots 804 can allow for rotation of 24 degrees or more. This allows first attachment 502 and second attachment 504 to be installed in the majority of existing soft, open, or weak stories without modification. Additionally or alternatively, the relative adjustment can rotate during seismic events to prevent bending loads from being transmitted to system elements, thus keeping all linear system elements in tension or compression.

Figure 9:
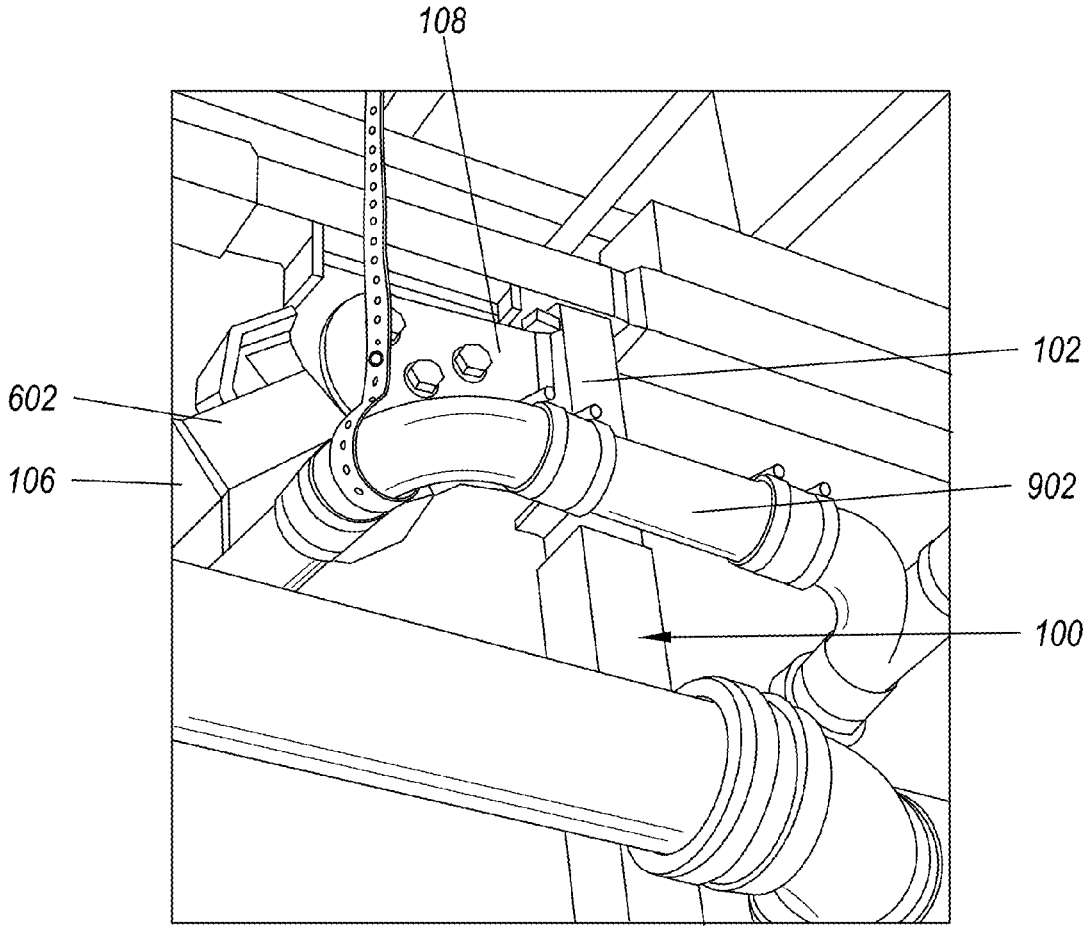
FIG. 9 illustrates an example of a S-T frame adjusted to accommodate existing structures within a building.

FIG. 9 illustrates an example of the system 100 adjusted to accommodate existing structures within a building. In particular, the system 100 can be adjusted to pass around pipes, ducts, wiring or any other features. One of skill in the art will appreciate that the system 100 can accommodate existing structures greatly simplifies the design and installation of the retrofit.

FIG. 9 shows that the friction bolted connection 108 can be adjusted to maneuver the concentric brace 106 around the piping 902. I.e., the angle of the friction bolted connection 108 relative to the articulated frame 104 need not be exactly along the diagonal. Instead, the friction bolted connection 108 can be adjusted to allow the concentric brace 106 to connect to the opposing corner.

Figure 10:
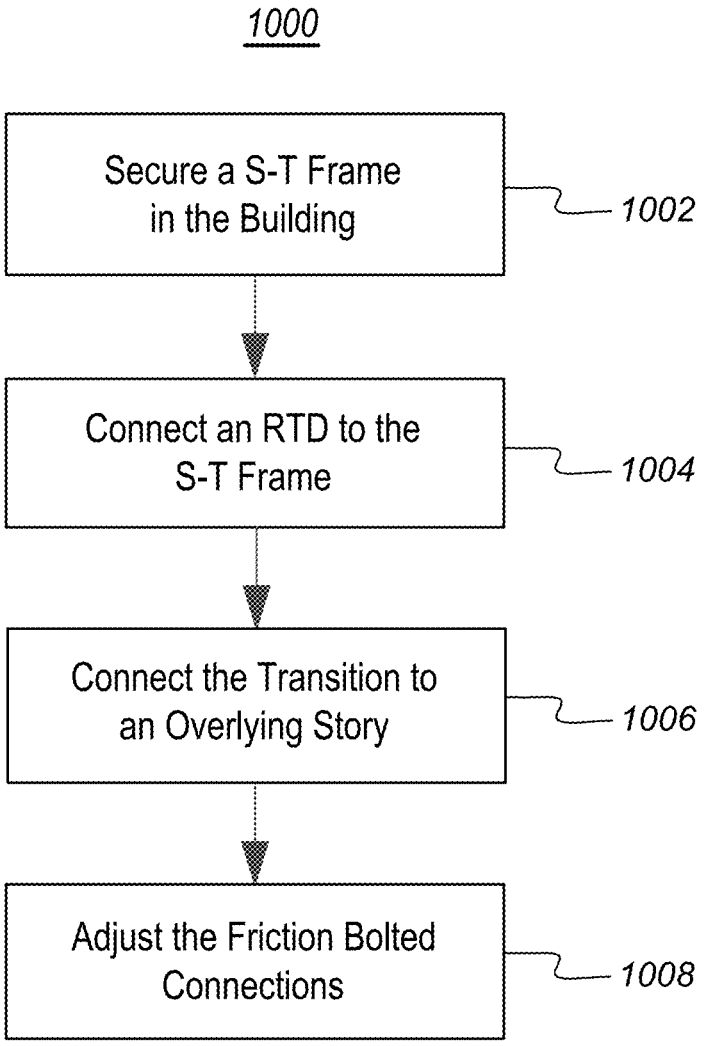
FIG. 10 is a flowchart illustrating a method of retrofitting a building to increase earthquake resistance.

FIG. 10 is a flowchart illustrating a method 1000 of retrofitting a building to increase earthquake resistance. For example, the method 1000 can include installing a system for transferring forces within a building during an earthquake. In at least one implementation, the system can be any system for retrofitting a building to increase earthquake resistance, such as the system 100 of FIGS. 1A and 1B. Therefore, the method 1000 will be described, exemplarily, with reference to the system 100 of FIGS. 1A and 1B. Nevertheless, one of skill in the art can appreciate that the method 1000 can be used to produce a system other than the system 100 of FIGS. 1A and 1B.

The system can be installed within a soft, open, weak, or irregular story of the building. For example, the soft, open, weak, or irregular story can include a garage, parking structure or other large open spaces. Additionally or alternatively, the system can be installed in multiple stories within the building. E.g., if the building included a large open room above the parking structure, neither the parking structure nor the large open room would be sufficiently resistant to lateral forces. Therefore, a first system can be installed within the parking structure and a second system can be installed within the large open room effectively transferring the forces to the third story, where it can be resisted within the structure of the building.

The system can be used to retrofit a building to make the building more earthquake resistant. In particular, the system can be used to reduce and/or redistribute forces within a building during an earthquake. Earthquake resistant structures are intended to withstand the largest earthquake of a certain probability that is likely to occur at their location. This means the loss of life should be minimized by preventing collapse of the buildings for rare earthquakes while the loss of functionality should be limited for more frequent ones. Thus, the system can reduce and/or redistribute forces within the building to increase earthquake resistance. Specifically, the system can satisfy the FEMA and ASCE recommended safety criteria: "collapse prevention" in a 2% in 50 year earthquake and "life safety" in a 10% in 50 year earthquake. If the upper levels do not have design deficiencies, then the system can be tuned to the enhanced safety objective of "immediate occupancy" in a 10% in 50 year earthquake. The system can be further tuned to prevent damage under smaller earthquakes and wind loads. This means that dwellings are habitable and repairable after a major earthquake. No other system offers this.

In particular, the system can transfer a portion of the lateral motion from an earthquake through an existing soft, open, weak, or irregular story in a multi-story building to an overlying story. This transfer is affected without relying on the seismic strength of this existing soft, open, weak, or irregular story. Furthermore, lateral accelerations that exceed the strength of the overlying story are reduced in magnitude via non-linear friction damping to minimize damage to the overlying story (i.e., the induced energy from seismic shock force is dissipated via friction and controlled displacements). When such lateral accelerations cannot be so reduced, displacement of the overlying story is then limited to prevent collapse of the soft, open, weak, or irregular story.

FIG. 10 shows that the method 1000 can include securing 1002 an S-T frame in the building. For example, the S-T frame can be anchored into the footing, foundation, retaining wall, floor or underlying structure of the soft, open, weak, or irregular story. For example, the bolts can be secured directly into the footing, foundation, retaining wall, floor or underlying structure. Additionally or alternatively an anchor or other mechanism can be sunk into the footing, foundation, wall, floor or underlying structure and the bolts can be threaded into the anchor or other mechanism.

The S-T frame is configured to absorb some of the forces imparted by an earthquake to a building and transfer the remaining forces to areas in such a manner that they can be better withstood. By analogy, the S-T frame functions as a shock absorber in a car. When a car rolls over a large hole in a road, the shock absorber reduces shock felt in the passenger compartment. If the hole is too large or the speed too great for the shock absorber to fully reduce, a bumper prevents damage to the car and allows a greater percentage of the shock into the passenger compartment.

The S-T frame can include an articulated frame. The articulated frame can include a rectangular or quadrilateral frame that has one or more articulated joints. I.e., the frame can include flexible joints. This allows sections of the articulated frame to move relative to one another. In particular, the articulated frame can "skew" or lean from vertical to a non-vertical position as described above. Consequently, the articulated frame acts as an inverted pendulum.

One of skill in the art will appreciate that the articulated frame provides a number of benefits. For example, the articulated frame can fit an existing irregular building geometry without customizing each component. I.e., the articulated frame can be sized according the building geometry but other components of the system can remain unchanged, allowing for easy engineering of a retrofit. Additionally or alternatively, the articulated frame does not require interrupting existing building utility services (plumbing, gas, HVAC, electricity, etc). In particular, the articulated frame can be attached to an existing building without requiring utility services to be shut off, even temporarily. In addition, the articulated frame minimizes the footprint of the system, meaning that existing utility structures, such as pipes, duct work, etc. do not need to be moved to allow for installation of the articulated frame. This reduced footprint prevents, for example, the loss of parking space when installed in a soft, open, or weak story that provides covered parking both during and after construction.

The S-T frame can also include a concentric brace. The concentric brace can pass through the center of the articulated frame. The concentric brace can be configured to restrict the motion of the articulated frame. I.e., the concentric brace can ensure that the articulated frame does not distort beyond a desired amount. The amount of distortion allowed by the concentric brace can depend on the capacity of the structure to distort or sway under the force of an earthquake and the applicable building codes for earthquake resistance. That is, the amount of distortion allowed in the articulated frame by the concentric brace can be customized to the building which is being retrofitted.

The S-T frame can further include friction bolted connections. The friction bolted connections can act as regular non-slip connections until loads are applied in excess of the capacity of the supported structure. After this load, the slippage of these connections is used to damp the accelerations transmitted through them. The magnitude of this slippage is limited to prevent collapse of the frame and the supported structure.

The friction bolted connection can include a first attachment. The first attachment can include a circular plate that is configured to attach to the other connection parts. I.e., the first attachment can be connected to the other parts of the friction bolted connection, as described below. For example, the first attachment can be permanently attached to a portion of the articulated frame 104 of FIGS. 1A and 1B, allowing it to be connected to other portions of the S-T frame.

The friction bolted connection can include a second attachment. The second attachment can be secured to an external device configured to connect to the first attachment. For example, the second attachment can include the RTD 112 or anchor 110 of FIGS. 1A and 1B allowing the RTD 112 or anchor 110 to be attached to the articulated frame 104.

The friction bolted connection can include a third attachment. The third attachment can be secured to a second external device configured to connect to the first attachment and the second attachment. For example, the third attachment can include the concentric brace 106 of FIGS. 1A and 1B. Additionally or alternatively, the third attachment can include a spacer plate or other device configured to properly space the friction bolted connection.

The friction bolted connection can include a bolt. The bolt can include a threaded shaft and a nut to hold the shaft in the desired position. The tighter the nut is secured on the bolt (i.e., the more the nut is threaded onto the shaft) the higher the compression on the first attachment, the second attachment and the third attachment. Because the amount of friction is proportional to the normal force (in this case, the compression force applied by the bolt) the tighter the bolt, the more friction applied to the first attachment, the second attachment and the third attachment. I.e., the bolt can be tightened or loosened to change the threshold of deformation, described above. One of skill in the art will appreciate that multiple bolts 508 can be used to allow the friction bolted connection 108 to be adjustable, both in angle of connection and strength of compression.

The friction bolted connection can moreover include a washer. The washer is a thin plate (typically disk-shaped) with a hole (typically in the middle) that is normally used to distribute the load of the bolt. The washer prevents the loss of pre-load due to Brinelling, localized yielding, and high stress after torque is applied to the bolt.

FIG. 1 additionally shows that the S-T frame can additionally include one or more anchors. The anchors can allow the articulated frame to be attached to a wall, floor, foundation, footing or other attachment point in the area. For example, the anchors can be attached to the articulated frame using a friction bolted connection to a foundation or retaining wall such that lateral ground motion along the foundation or wall is transferred to the articulated frame. This motion is converted into a reduced damped force in the articulated frame. This damped force is transferred to the RTD. The RTD transfers the reduced damped forced in a distributed manner to the supported structure while preventing lateral motion beyond desired levels.

FIG. 10 also shows that the method 1000 can include connecting 1004 a RTD to the S-T frame. The RTD can include a truss structure that acts to transfer force to the upper structure. A truss is a structure comprising one or more triangular units constructed with straight members whose ends are connected at joints referred to as nodes. External forces and reactions to those forces are considered to act only at the nodes and result in forces in the members which are either tensile or compressive forces. A truss is said to be rigid when there is effectively no relative motion of any point on any member of the truss with respect to any other point on any other member of the truss. This rigidity is relative to the structure to which the RTD connects. In most circumstances, horizontal diaphragms in buildings resist in-plane deformation via shear resistance; consequently, they are more flexible than a truss. Thus, the RTD provides a stable horizontal plane which is connected to the upper structure, transferring force to the upper structure in a distributed manner via a series of individual connection points along the chords of the RTD.

The RTD can be connected to the articulated frame using a friction bolted connection. Thus, the articulated frame and adjoining RTD can change shape under force from a rectangle to a parallelogram. A parallelogram is a simple (non self-intersecting) quadrilateral with two pairs of parallel sides. I.e., the length of the sides of the articulated frame and the RTD remain constant and the RTD remains horizontal but the angle between intersecting sides may change under force. This change of angle allows the articulated frame to absorb and dampen the force of the earthquake without bending or failing.

The RTD can include a tie rod. A tie rod is a slender structural unit used as a tie capable of carrying tensile loads. The tie rod can horizontally connect corners of an articulated frame or proximate articulated frames. I.e., the tie rod can be located in a horizontal (or nearly horizontal plane) and secure nearby articulated frames to one another. That is, the tie rod 114 can help the RTD 112 to remain rigid, even under stress.

The articulated frame, the concentric brace and the RTD have slip connections that are welded in the field after assembly. This allows the articulated frame, the concentric brace and the RTD to be sized according to the desired installation space. I.e., the articulated frame, the concentric brace and the RTD can be designed for the installation space and the slip connections can be adjusted, on site, to conform exactly to the installation space.

FIG. 10 moreover shows that the method 1000 can include connecting 1006 the transition, and indirectly the S-T frame, to the overlying story. For example, the transition can be attached to the flexible ceiling diaphragm of the open, weak, or irregular story. The overlying story can thus be left largely untouched during installation, allowing for the portion of the building to which modifications must be made reduced to a minimum. This allows the building to remain in use (e.g., the parking structure can still be used for parking and the living spaces inhabited) even during installation. In addition, any openings to the building can remain unmodified. Thus, the opening to the parking structure, for example, does not need to be narrowed beyond the width required for continued parking for proper support.

For example, the RTD, the transition can connect the RTD to the overlying story. In particular, the RTD, the transition and the overlying story can be bolted to one another, forming a rigid connection. This rigid connection can effectively transfer forces from the underlying story to the overlying story. I.e., the lateral forces "bypass" the open, weak, or irregular story.

FIG. 10 additionally shows that the method 1000 can include adjusting 1008 the friction bolted connections. The friction bolted connection can be a connection that allows movement of the constituent parts only beyond a specific threshold of applied force. I.e. the fiction bolted connection can be adjusted 1008 to set the threshold at a desired level. Consequently, the friction bolted connection is adjustable 1008 to any desired threshold.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for retrofitting a building to make the building more earthquake resistant, the system comprising:
- a seismically-tuned frame;
  - configured to:
    - absorb a first portion of the forces imparted by an earthquake; and
    - transfer a second portion of the forces in a distributed manner to areas of a building such that they can be better withstood; and
  - includes:
    - an articulated frame; and
    - a concentric brace configured to prevent deformation of the articulated frame beyond a predetermined amount;
- a rigid truss diaphragm, wherein the rigid truss diaphragm is:
  - connected to the seismically-tuned frame; and
  - configured to transfer the second portion of the forces imparted by an earthquake to an overlying structure;
- one or more friction bolted connections, wherein the one or more fiction bolted connections:
  - are configured to:
    - connect the seismically-tuned frame to the rigid truss diaphragm; and
    - act as a regular non-slip connection until loads are applied in excess of a pre-determined threshold; and
  - includes:
    - an attachment permanently attached to the articulated frame;
    - a second attachment configured to secure the rigid truss diaphragm;
    - a third attachment configured to secure the concentric brace; and
    - a bolt configured to increase the compression between the first attachment, second attachment and third attachment;
- a transition configured to connect the rigid truss diaphragm to the overlying structure.

2. The system of claim 1, wherein the seismically-tuned frame includes one or more anchors.

3. The system of claim 2, wherein the anchors include one or more bolts.

4. The system of claim 1 wherein the rigid truss diaphragm includes one or more diagonal tie rods.

5. The system of claim 1, wherein the articulated frame includes a slip connection configured to facilitate erection until the slip connection is permanently affixed.

6. The system of claim 1, wherein the one or more friction bolted connections include a curved slot.

* * * * *